United States Patent [19]

van Issum

[11] 4,323,612

[45] Apr. 6, 1982

[54] CARPETS HAVING PILE OF CRIMPED AND NON-CRIMPED NYLON FILAMENTS

[75] Inventor: Ernst J. van Issum, Echternach, Luxembourg

[73] Assignee: Monsanto Company, St. Louis, Mo.

[21] Appl. No.: 142,208

[22] Filed: Apr. 21, 1980

Related U.S. Application Data

[63] Continuation of Ser. No. 37,605, May 10, 1979, abandoned.

[51] Int. Cl.[3] ..... D03D 27/00

[52] U.S. Cl. ..... 428/89; 428/92; 428/93; 428/94; 428/97

[58] Field of Search ..... 428/89, 92, 93, 94, 428/97; 156/72

[56] References Cited

U.S. PATENT DOCUMENTS

| | | | |
|---|---|---|---|
| 2,815,558 | 12/1957 | Bartovics | 428/89 |
| 3,061,998 | 11/1962 | Block | 57/140 |
| 3,132,462 | 5/1964 | Kim | 57/34 |
| 3,175,351 | 3/1965 | Block | 57/34 |
| 3,940,522 | 2/1976 | Wessells | 428/17 |

FOREIGN PATENT DOCUMENTS

| | | | |
|---|---|---|---|
| 1000366 | 8/1965 | United Kingdom | 57/157 |
| 1217226 | 12/1970 | United Kingdom | 57/157 |
| 1454521 | 11/1976 | United Kingdom | 57/157 |
| 1459098 | 12/1978 | United Kingdom | 57/157 |

*Primary Examiner*—Marion McCamish
*Attorney, Agent, or Firm*—John W. Whisler

[57] ABSTRACT

Carpets are provided having a pile wherein the individual tufts of the pile are made from a plurality of continuous filament nylon yarns, at least one of which is composed of filaments having crimp (extant or latent) and the other yarn or yarns are composed of filaments having no crimp. Carpets of the invention, particularly velour carpets have improved tuft identity and are free from streaks.

5 Claims, No Drawings

CARPETS HAVING PILE OF CRIMPED AND NON-CRIMPED NYLON FILAMENTS

This is a continuation of application Ser. No. 037,605 filed May 10, 1979 and now abandoned.

BACKGROUND OF THE INVENTION

A. Field of the Invention

This invention relates to novel carpets, and particularly to novel carpets having a pile wherein the individual tufts of the pile are made from synthetic continuous filament yarns. The invention also relates to a novel process for producing such carpets.

B. Description of the Prior Art

The pile of carpets is made from yarns that may either be spun from staple fibers in the traditional way or may be of the continuous filament type. Continuous filament yarns, for example of nylon, are normally textured in some way and the filaments are either twisted or tangled together so as to give them coherence. Continuous filament yarns are usually cheaper to produce than staple yarns but carpets made from them may sometimes present a somewhat less than ideal appearance when the pile is cut, for example, to form a velour surface rather than a loop pile surface. In particular, not only is there a tendency towards loss of tuft identity but also the carpet can present a streaky appearance which is due to slight differences in texturing at different places along the length of the yarn. Pile yarns made from staple fibers are normally better in these respects but their production involves more process steps and often, depending on pile height, their cost is substantially higher. There is therefore a need for a carpet, particularly a velour carpet, having a pile made from continuous filament yarn and having an improved tuft identity and freedom from streaks.

It has been proposed, in British Pat. No. 1,217,226, to produce multifilament yarns by combining two thermoplastic yarns that have been differently heated and then crimped so as to produce differing latent crimp development characteristics in the two yarns, and then treating the combined yarn to develop the differing latent crimp characteristics. The yarns can be used in carpet pile and give reduced "rowiness". However, as explained in the British Patent, "rowiness" is caused by pile tufts standing upright in rows and is a mechanical phenomenon. It is not to be confused with "streaking" resulting from texturing variations, which is the problem to which the present invention is addressed, as explained above. Further, a "rowy" appearance very often shows as rows extending transversely across the machine direction whereas streaks extend in the machine direction; this is a consequence of the different reasons for occurrence of the two phenomena.

It has also been proposed, in U.S. Pat. Nos. 3,061,998, and 3,175,351, to produce a bulked continuous singles yarn in which some of the filaments are crimped to provide bulk and others are in relatively straight form to provide dimensional stability. Other patents proposing combined yarns comprising crimped and non-crimped filaments are British Pat. Nos. 1,000,366, 1,454,521 and 1,459,098. However, these U.S. and British patents do not propose the use of such yarns in carpets and in particular do not contain any teaching concerning the problem of streaking in cut pile carpets.

SUMMARY OF THE INVENTION

In accordance with the present invention carpets are provided having a pile wherein individual tufts of the pile are made from a plurality of continuous filament nylon yarns, at least one of which comprises filaments (hereinafter referred to as "crimped filaments") having a crimp (extant or latent) and the other yarn or yarns comprises filaments (hereinafter referred to as "non-crimped filaments") substantially without extant crimp or latent crimp (i.e. flat filaments), and substantially all of the filaments being in a molecularly oriented state.

The invention also comprises a process for producing a carpet according to the invention, which comprises feeding individual tufting positions of a carpet loom or tufting machine with a plurality of continuous filament nylon yarns, at least one of the yarns comprising crimped filaments and the other yarn or yarns comprising non-crimped filaments, and substantially all of the filaments being in a molecularly oriented state.

The carpets of the present invention are characterized in having a pile made from continuous filament yarn and, in the case of velour carpets having improved tuft identity and being free from streaks.

PREFERRED EMBODIMENTS OF THE INVENTION

Preferably, each pile tuft of the carpets of the invention is composed of a plurality of continuous filament nylon yarns, at least one of which contains crimped filaments and at least one of which contains non-crimped filaments. Preferably, each yarn consists essentially of either crimped filaments or non-crimped filaments.

The yarns from which each tuft is constructed are preferably plied or folded together before being fed to the loom or tufting machine. However, the yarns can maintain their separate identities up to this point. Within each yarn, the filaments can be twisted or tangled together to give coherence.

Production of the carpet of the invention can follow normal methods, except that more than one yarn is fed (separately or plied together) to each tufting position. The process of the invention is particularly suitable for the production of tufted or of Wilton woven carpet. It is not normally so useful in making Axminster carpets since one would not normally use continuous filament yarns in this form of construction. The machine may need to be modified by the addition of extra creel positions to accommodate the extra bobbins of yarn employed in the process of the invention, but this is not necessary where the yarns are first plied or folded as mentioned above. As stated above, the advantages of the invention are particularly notable in the constructions of carpets having a cut pile, for example cut-loop, velour or high-low tip shear. Pile cutting is best effected before the carpet is dyed; after dyeing, the pile may be sheared, for example to obtain a more level pile height or to achieve a special effect as mentioned below.

Where yarn comprises filaments possessing latent crimp, the latent crimp can be developed when a carpet having a pile formed from the yarn is dyed. In such a case, crimp development then causes the crimped filaments to contract because their length is taken up in the convolutions of the crimped configuration, whereas the non-crimped filaments do not contract in this way, so that the non-crimped filaments in the dyed carpet protrude slightly above the crimped filaments. This gives an interesting "two-height" appearance, and in fact different carpet appearances can then be obtained by either shearing or leaving the pile unshorn, particularly where the crimped and non-crimped yarns have different dyeing properties as explained below. Moreover, shearing can result in a similar difference of appearance depending on whether it is done before or after dyeing. These effects are particularly pronounced where the crimped and non-crimped filaments are of different colors or dyeabilities as described above. Alternatively, if desired, this effect of different pile heights due to contraction on development of latent crimp can be reduced by making the non-crimped filaments heat-shrinkable. Then, the crimped and non-crimped filaments can be made to have substantially the same pile height after dyeing and, in this way, the waste entailed in subsequent shearing operations can be avoided or reduced.

The yarns are of nylon, especially nylon 6 or nylon 6,6, but other possible nylon polymers are, for example, nylon 11 (polyundecylamide), nylon 6,10 (polyhexamethylene sebacate), nylon 12 (polylauramide) or an aromatic polyamide such as nylon 6T (polyhexamethylene terephthalamide).

The yarns can be of different chemical composition if desired. Thus, they can be of polymers having different dyeabilities, thus increasing the range of visual effects that are possible, particularly in view of the improved tuft definition that can be achieved by means of the invention. Thus, spotted or marl effects can be produced in this way. Moreover, there can be filaments of different dyeability within each of the crimped and non-crimped filament yarns. Even when the crimped and non-crimped filament yarns are made of the same polymer, it is often found that the former are less dyeable than the latter. This effect can be masked or enhanced by an appropriate choice of different polymers for the yarns if desired. As will be seen from the examples, chemical variations of the polymer to produce various dye-susceptibilities can be exploited to produce a variety of different visual effects.

The yarn filaments are in a molecularly oriented state, and the molecules of the filaments are thus predominantly aligned in directions parallel to the filament axis. The orientation can for example be induced by drawing the filaments, either hot or cold according to polymer type, and such drawing can be conveniently effected at one or more of several stages in production of the yarn. For example, drawing can be carried out immediately after the filaments are spun or in a separate drawing operation; in the case of the crimped filaments the drawing operation preferably takes place immediately before that of crimping. Suitable draw ratios usually lie between 2:1 and 6:1, preferably between 2.5:1 and 4.5:1. As an alternative or in addition to orientation by drawing, molecular orientation can be induced in the filaments by melt spinning them at a very high speed, for example with take-off at 2,500 meters per minute or more.

Methods for imparting crimp or latent crimp to continuous filaments are well known. These can comprise for example stuffer-box crimping, in which the filaments are subjected to heat-setting conditions while compressed into a crimped configuration in a confined space; gear crimping, in which the filaments pass between intermeshing gear wheels; edge crimping, in which filaments are passed over the edge of a heated metal plate so that the part of each filament contacting the plate is subjected to a different thermal history from that of the part of the filament not contacting the plate; or any means of producing molecularly oriented crimped filaments in a simultaneous or sequential draw texturing operation. Gear crimping is preferred. False-twist crimping is not usually suitable for carpet yarns. The crimp can either by extant or latent; in the latter case the crimp is developed in a subsequent heat treatment, for example when a carpet containing the yarn is piece-dyed, as explained above.

Where the filaments in a yarn are tangled with one another or twisted, this can be done by conventional means; thus twisting can, for example, be by ring-spinning while tangling normally includes a step of subjecting the filaments to a turbulent flow of gas which can be heated if desired, for example air, hot air or steam. Superheated steam is preferred. Suitable designs of jets or nozzles for producing such a turbulent gas stream are well known.

Where the plurality of yarns are plied or folded together, preferably there are two or three such yarns. Preferably each yarn end consists essentially of crimped filaments or of non-crimped filaments as the case may be. Alternatively, each yarn end can comprise both crimped and non-crimped filaments. Within each single yarn end, the filaments can be twisted or tangled together to give coherence. The yarn ends can conveniently be plied or folded by twisting on a doubler or up-twister for example. Preferably, the twist is between 17 and 35 turns per meter.

The number of filaments in each yarn and their diameter can be as normally used in continuous filament carpet yarns. Thus each yarn can for example comprise from 20 to 500 filaments, preferably 50 to 200, each of dTex 5 to 50, preferably from 10 to 40. The filaments can differ in diameter. Each yarn preferably has a total dTex (decitex) of from 600 to 6000, more preferably 1000 to 4500.

The relative proportions of crimped and non-crimped filaments in the pile is a matter of choice depending on the properties required in the final carpet. A more relevant consideration is the proportions of crimped and non-crimped filaments in each tuft (i.e. in the combined yarns), but in general it is preferred that between 25 and 75% (by number) of either type of filament be present. Very often between 35 and 65% of either type can be present and for example they can be of equal number. Often, however, it is preferred that the crimped filaments be more numerous than the non-crimped filaments, e.g. in the ratio 60% to 40%. The crimped and non-crimped filaments can additionally be of different dTex per filament if desired; preferably, the filament dTex ratio is not greater than 2:1.

The invention is illustrated by the following examples.

EXAMPLE 1

In this example, a yarn consisting wholly of crimped filaments and another consisting wholly of non-crimped filaments were fed together to each needle of a carpet tufting machine, one yarn consisted of 96 filaments of acid dyeable nylon 66 which had been drawn, crimped and tangled to a total final decitex of 2100.

Prior to drawing, the filaments were of triskelion cross-section with a modification ratio (i.e. the average ratio of the diameter of the circumscribed circle to the diameter of the inscribed circle of the filament cross-sections) of 1.70.

A yarn bulk measurement of 15% was determined by measuring the contraction of a loaded skein of yarn after insertion in a hot air chamber having a temperature of 180° C. for a period of 5 minutes.

The degree of filament interminglement, referred to as "tangle", was determined by passing the yarn over a grooved spiked wheel and counting the number of deflections of the wheel per meter of running yarn. In this example a tangle of 21 was observed.

The other yarn consisted of the same acid dyeable nylon 66 with 1.7 modification ratio of drawn, tangled non-crimped filaments and having the following properties:

| | |
|---|---|
| Decitex | 2100 |
| Number of filaments | 96 |
| Bulk percent | 0 |
| Tangles per meter | 12 |

The two yarns were fed together to each needle of a Singer ⅛-inch (3.18 mm) gauge tufting machine. A Typar backing was used. (Typar is a trademark of duPont for a spun-bonded polyester fabric backing). Two cut-pile (velour) carpets were made, one having a pile height of 9 mm. and 34 stitches per 10 cm. of carpet length, and the other having a pile height of 14 mm. and 28 stitches per 10 cm. of carpet length.

The fabrics were dyed dark red using acid dyes (Tectilon yellow 4R, red 2B and blue 4R at 98° C. Tectilon is a tradename of Ciba Geigy Corporation. The hot dye bath developed the crimp in the crimp filament fibers and caused both the crimped and non-crimped filament fibers to shrink. After dyeing, the tufts were anchored by means of a latex backing compound (precoat Intex 164 and Intex 131 for non-gel foam backing). The weight of one square meter of the fabrics before application of the latex compound were 1022 grams and 1260 grams respectively.

The resulting carpets had good uniformity of appearance overall, with only a very slight trace of streaking discernible in the 9 mm. pile carpet and none in the 14 mm. pile carpet. Tuft definition was good, emphasized by a slight two-color effect within individual tufts, the non-crimped filaments dyeing slightly darker than the crimped filaments and this effect being more noticeable in the 9 mm. pile carpet than in the other.

For the purpose of comparison, two carpets were made as above but respectively using each of the two yarns alone. Two ends were fed to each needle. Thus in one carpet the pile consisted entirely of crimped filaments, and in the other carpet the pile consisted entirely of non-crimped filaments. The all-crimped pile carpet showed an unacceptable degree of streaking and tuft definition was poor (felted). The all-non-crimped pile carpet had an excessive luster and very high streaking and the tufts did not completely cover the backing fabric. Neither of these carpets could be considered commercially acceptable.

EXAMPLE 2

In this example, crimped and non-crimped filament yarns were combined at the carpet tufting machine. Half of the filaments in the crimped filament yarn were basic-dyeable and half acid-dyeable, whereas the non-crimped yarn was composed entirely of acid-dyeable filaments.

The non-crimped filament yarn was the same as the one used in Example 1. The crimped filament yarn comprised 34 acid-dyeable nylon 6,6 filaments and 34 basic-dyeable, acid-dye-resist nylon 6,6 filaments, and had the following properties:

| | |
|---|---|
| Decitex | 1440 |
| Number of filaments | 68 |
| Bulk percent | 16.0 |
| Tangles per meter | 20 |

The two yarns were fed together to each needle of the carpet tufting machine used in Example 1. A Typar spun-bonded polyester fabric backing was used as before, and a cut-pile (velour) carpet was made having a pile height of 14 mm. and 28 stitches per 10 cm. of carpet length.

The tufted fabric was dyed brown using an acid dye (Tectilon acid) at 98° C., the basic-dyeable filaments being left undyed. The hot dye bath developed the crimp in the crimped filament yarn and caused both the crimped and non-crimped filament fibers to shrink. After dyeing the tufts were anchored by means of a latex backing as in Example 1. The weight of one square meter of the fabric before application of the latex compound was 1086 grams.

The resulting carpet had excellent uniformity of appearance overall, with no streaking, and a spotted light-/dark two-color effect as a result of the presence of both acid- and basic-dyeable fibers in the pile.

By employing both acid and basic dyes, further color effects could be obtained.

EXAMPLE 3

This example describes the production of carpets according to the invention wherein the pile is made from a plurality of yarn ends plied together.

Two yarn ends were plied together. One yarn end consisted of 96 filaments of acid dyeable nylon 66 which had been drawn, crimped and tangled to a total final decitex of 2100. Prior to drawing, the filaments were of triskelion cross-section with a modification ratio (i.e. the average ratio on the diameter of the circumscribed circle to the diameter of the inscribed circle of the filament cross-sections) of 1.70.

A yarn bulk measurement of 15% was determined by measuring the contraction of a loaded skein of yarn after insertion in a hot air chamber having a temperature of 180° C. for a period of 5 minutes.

The degree of filament interminglement, referred to as "tangle", was determined by passing the yarn over a grooved spiked wheel and counting the number of deflections of the wheel per meter of running yarn. In this example a tangle of 21 was observed.

The other yarn end consisted of the same acid dyeable nylon 66 with 1.7 modification ratio of drawn, tangled non-crimped filaments and having the following properties:

| | |
|---|---|
| Decitex | 2100 |
| Number of filaments | 96 |
| Bulk percent | 0 |
| Tangles per meter | 12 |

The plying operation was performed using a conventional up-twisting machine with 21 turns per meter of plying twist, and the resulting yarn was employed in making a carpet using a Singer ⅛ inch (3.18 mm) gauge tufting machine. A Typar spun-bonded polyester fabric backing was used. Two cut-pile (velour) carpets were made, one having a pile height of 9 mm. and 34 stitches per 10 cm. of carpet length, and the other having a pile height of 14 mm. and 28 stitches per 10 cm. of carpet length.

The fabrics were dyed dark red using acid dyes (Tectilon yellow 4R, red 2B and blue 4R) at 98° C. The hot dye bath developed the crimp in the crimped filament fibers and caused both the crimped and non-crimped filament fibers to shrink. After dyeing, the tufts were anchored by means of a latex backing compound (precoat Intex 164 and Intex 131 for non-gel foam backing).

The resulting carpets had good uniformity of appearance overall, with only a very slight trace of streaking discernible. Tuft definition was good, emphasized by a slight two-color effect within individual tufts.

In two further experiments, other yarn ends were similarly plied together and employed in making carpets. In one experiment, the two ends each consisted of 34 non-crimped filaments of drawn basic-dyeable nylon 6,6 and 68 filaments of gear-textured latent-crimped filaments of drawn acid-dyeable nylon 6,6 all the filaments within each yarn end being tangled together. In another experiment, one yarn end consisted of 34 non-crimped filaments of drawn basic-dyeable nylon 6,6 tangled with 68 filaments of gear-textured latent crimped filaments of drawn acid-dyeable nylon 6,6; the other yarn end similarly comprised 34 non-crimped filaments tangled with 68 crimped filaments but the non-crimped filaments were acid dyeable and the crimped filaments were basic-dyeable. When incorporated into carpets and cross-dyed these two plied yarns gave a rich silky appearance and interesting two-color effects, with hardly discernible streaking.

I claim:

1. A cut pile tufted carpet wherein each tuft consists of two continuous filament nylon yarns plied together, in which one of the yarns is composed of crimped filaments and the other yarn is composed of non-crimped filaments wherein all of the filaments are of substantially the same dTex and the ratio of crimped filaments to non-crimped filaments is 3:1 to 1:3.

2. A carpet according to claim 1, in which the crimped and non-crimped filaments have different dyeabilities.

3. A carpet according to claim 1, in which the combined yarns have a total dTex of from 1,000 to 4,500 and comprise from 50 to 200 filaments each of dTex 10 to 40.

4. A carpet according to claim 1, in which the pile is cut to form a velour, cut-loop or high-low tip-shear carpet.

5. The carpet according to claim 1 wherein at least 60% by number of the filaments are crimped.

* * * * *